US005369421A

United States Patent [19]

Tomono et al.

[11] Patent Number: 5,369,421

[45] Date of Patent: Nov. 29, 1994

[54] METHOD OF PRINTING COLORED IMAGE AND APPARATUS SUITABLE THEREFOR

[75] Inventors: Hidenori Tomono; Yasuo Katano; Hiromichi Komai, all of Yokohama, Japan

[73] Assignee: Ricoh Company, Ltd., Tokyo, Japan

[21] Appl. No.: 16,089

[22] Filed: Feb. 10, 1993

[30] Foreign Application Priority Data

Feb. 14, 1992 [JP] Japan ..... 4-059808

[51] Int. Cl.[5] ..... B41M 5/00

[52] U.S. Cl. ..... 346/76 R; 346/76 PH; 346/135.1

[58] Field of Search ..... 346/76 PH, 76 R, 1.1, 346/135.1, 76 L

[56] References Cited

U.S. PATENT DOCUMENTS 5,175,568 12/1992 Oyamaguchi et al. ..... 346/1.1
5,177,506 1/1993 Katano ..... 346/1.1
5,200,762 4/1993 Katano et al. ..... 346/76 R

FOREIGN PATENT DOCUMENTS 4010275 10/1990 Germany .
40-18992 8/1965 Japan .
40-18993 8/1965 Japan .
44-9512 5/1969 Japan .
54-41902 12/1979 Japan .
63-264392 11/1988 Japan .

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

A recording method in which a liquid adhesion region and a liquid non-adhesion region of a surface of a material are utilized in a recording process. A latent image is formed by applying a heat onto portions of recording material. The recording material includes a surface having a receding contact angle, which receding contact angle decreases either when a temperature of the surface becomes more than a predetermined temperature in a condition where the surface is in contact with a liquid or when the surface is made to come in contact with a liquid in a condition where the temperature of the surface is at or exceeds a predetermined temperature. A plurality of visible color images corresponding to the latent image are formed by causing the surface come into contact with a recording agent containing a coloring agent and a fine powder of the recording material, each color image except for the color image formed first being formed on a layer formed of fine powder contained in a previously applied recording agent. The visible color images on the recording material are transferred onto a recording paper.

9 Claims, 3 Drawing Sheets

METHOD OF PRINTING COLORED IMAGE AND APPARATUS SUITABLE THEREFOR

BACKGROUND OF THE INVENTION

The present invention is generally related to a recording method and a recording apparatus, and more particularly to a recording method and a recording apparatus in which a liquid adhesion region and a liquid non-adhesion region of a surface of a material are utilized in a printing process.

One of the typical printing methods utilizing a liquid adhesion region and a liquid non-adhesion region of a surface of a material is an offset printing method. A printing apparatus using this offset printing method has a large size when a plate making process using an original plate and a printing process using a printing plate is incorporated into one apparatus. Accordingly, most of office use offset plate-making and printing apparatuses, which require compactness, are necessarily separated into a plate making apparatus and a printing apparatus.

In order to eliminate the above mentioned problem, apparatuses have been suggested in which a liquid adhesion region and a liquid non-adhesion region, which region correspond to image information, can be repeatedly formed, that is, can be reversibly operated. Examples for such apparatuses are listed in the following.

(1) water development method

Applying an electric charge on a hydrophobic photoconductive layer, exposing the layer to a light, forming a pattern including a hydrophobic part and a hydrophilic part on a surface of the photoconductive layer. Transferring onto a paper by adhering a water base developing agent on the hydrophilic part. (Japanese Patent Publication No.40-18992, Japanese Patent Publication No.40-18993, Japanese Patent Publication No.44-9512, Japanese Laid-Open Patent Application No.63-264392)

(2) a method utilizing a photochemical reaction of photochromic compounds

Causing photochromic compounds, such as spiropyran or azo dye, to be hydrophilic by photochemical reactions by irradiating an ultra-violet beam on a layer containing the photochromic compounds. ("Macromolecular thesis collection" Vol.37, No.4, p287, 1980)

(3) a method utilizing inner displacement-stress

Forming an adhesion region and a non-adhesion region for an ink on a material surface by forming amorphous and crystallized states by physical action. (Japanese Patent Publication No.54-41902)

According to the above method (1), the hydrophilic part is eliminated by discharge of electric charge after transferring a water base ink onto a paper, and thus the next printing operation can be performed. Namely, an original plate (photoconductive material) can be repeatably used. However, since this method is based on an electrophotography process, a long processing time is required such as processes for charging, exposure, development, transfer, and discharging. Thus, this method has disadvantages in miniaturization of size, reduction of cost, and realization of maintenance free operation.

According to the method (2), the hydrophobic and the hydrophilic regions can be reversely and freely controlled by selectively irradiating an ultra-violet beam or a visible beam. However, due to a low quantum efficiency, a reaction time is very long and a recording time is slow. Additionally, there is a disadvantage of low stability of the material. Therefore, this method has not reached the usable level.

According to the method (3), a recording material is stable after the recording but it is possible that a physical structure change occurs due to a temperature change. Accordingly, there is a problem related to a storage. Additionally, since erasure of the recorded pattern is performed by applying a heat pulse to the pattern and immediately cooling the corresponding area, it becomes a complex process to perform a repeated printing operation.

The inventor has conducted a research into way to eliminate the above mentioned disadvantages of the conventional apparatuses. As the results of the research, an apparatus was suggested in German Laid-Open Patent Application No. 4010275 in which apparatus formation of a latent image and a visible image on the recording material, transfer of the visible image to a plain paper, and an erasure of the latent image are easily and repeatedly performed. The suggested apparatus can perform repeated printing of the same image as well as consecutive printing of different images.

The above mentioned apparatus uses a particular recording material and a contacting material. This particular recording material (hereinafter called recording material (A)) has a surface whose receding contact angle decreases when the surface is heated in a condition where the surface is in contact with a liquid or when the surface is in contact with a liquid in a condition where the surface is heated. The term "contact angle" refers to the angle by a vector which is tangent to a liquid which is in contact with a solid. The "receding contact angle", which is well known to those of ordinary skill in the art, is a measure of the wetting phenomena and is determined by slowly decreasing the size of the liquid until the drop of liquid recedes. The contacting material (hereinafter called contacting material (B)) is a liquid, a vapor or a material which liquidizes or generates a vapor at a temperature below the temperature at which the above mentioned receding contact angle begins to decrease. A latent image corresponding to the receding contact angle determined by controlling the temperature is formed on the surface of the recording material (A) by selectively heating the surface of the recording material (A) in a condition where the surface of the recording material (A) is contact with the contacting material (B) or by causing the surface of the recording material (A) to come in contact with the contacting material (B) after selectively heating the surface of the recording material (A). The latent image is made visual by a recording agent including a coloring agent, and then the visual image is transferred to a recording paper.

When printing a color picture by using the above mentioned recording method, for example as shown in FIG. 1, three single-color recording units are arranged in series. Each color of the three color is transferred to a sheet of paper by a respective one of the three recording units. Each of the recording units A, B, C of the apparatus shown in FIG. 1 comprises a latent-image forming device 1, an ink applicator 2, a recording material 3, transfer roller 5, a cleaner 6 and an erasing heater 7. The recording paper 4 passes, in turn, through a portion between each recording material and the respective transfer roller 5. Different color inks *2a*, *2b*, *2c* are provided in corresponding ink applicators 2. This apparatus has a problem in that dots of each color tend to have displacement, that is, an undesired displacement between the center of each dot image so that the printed images are not appropriately superimposed, as recording units for each color are separated from each other. Thus, a high quality multi-colored picture cannot be obtained. Further, with this apparatus, the size of the apparatus becomes large and the manufacturing cost is increased.

SUMMARY OF THE INVENTION

It is a general object of the present invention to provide a recording method and a recording apparatus by which the above mentioned disadvantages are eliminated.

A more specific object of the present invention is to provide a recording method and a recording apparatus using a recording method by which apparatus and method a high quality multi-colored picture is printed without displacement of each visible color image occurring.

In order to achieve the above mentioned objects, a recording method according to the present invention comprises the steps of:

forming a latent image by partially applying a heat onto a recording material, the recording material including a surface having a receding contact angle which receding contact angle decreases either when the temperature of the surface becomes more than a predetermined temperature in a condition where the surface is in contact with a liquid or when the surface is made to come in contact with a liquid in a condition where the temperature of the surface is at, or exceeds, a predetermined temperature;

forming a plurality of visible color images corresponding to the latent image by causing the surface to come in contact with a recording agent containing a coloring agent and a fine powder of the recording material, each color image, except for the color image formed first, being formed on a layer formed of the fine powder contained in a previously applied recording agent; and transferring the visible color images from the recording material onto a recording paper.

The recording apparatus according to the present invention comprises:

a latent-image forming means for forming a latent image by partially applying heat to a recording material, the recording material including a surface having a receding contact angle which receding contact angle decreases either when the temperature of the surface becomes more than a predetermined temperature in a condition where the surface is in contact with a liquid or when the surface is made to come in contact with a liquid in a condition where the temperature of the surface is at or exceeds a predetermined temperature;

a visible-image forming means for forming a plurality of visible color images corresponding to the latent image by causing the surface to come into contact with a recording agent containing a coloring agent and a fine powder of the recording material, each color image, except for color image formed first, being formed on a layer formed of the fine powder contained in a previously applied recording agent; and a transferring means for transferring the visible color images from the recording material onto a recording paper.

According to the present invention, all the visible color images can be transferred on the recording paper simultaneously. Therefore a possibility of displacement of visible color images is minimized and thus a high quality picture can be obtained.

Other objects, features, and advantages of the present invention will become more apparent from the following detailed description when read in conjunction with the accompanying drawings.

DETAILED DESCRIPTION OF THE PREFERRED EMBODIMENTS

Figure 1:
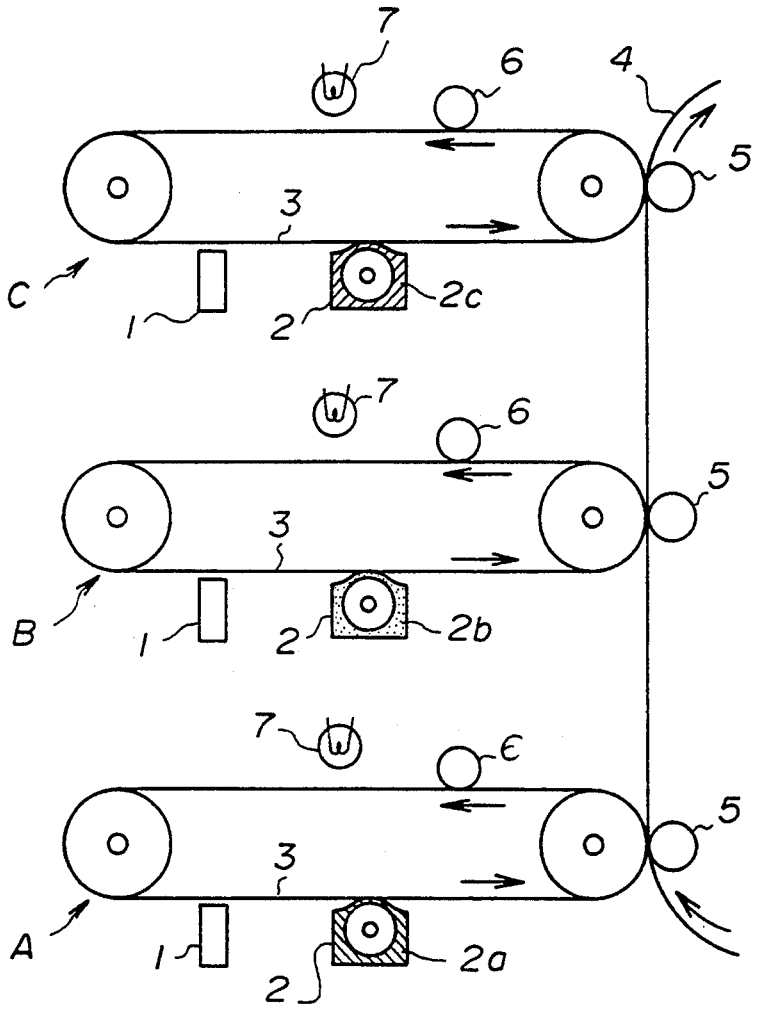
FIG. 1 PRIOR ART
FIG. 1 is a schematic illustration for explaining a structure of an example of a recording apparatus.

A description will now be given of the recording material (A) and the contacting material (B) used in the recording method according to the present invention.

At least a surface of the recording material (A) used in the recording method according to the present invention is formed with a material having a receding contact angle which receding contact angle decreases when the recording material (A) is heated in a condition where it is made to come in contact with a liquid and the decreased receding contact angle remains even when the recording material (A) is cooled. Additionally, the contacting angle increases by heating of the material in a condition where the recording material (A) is not in contact with a liquid. The material suitable for the above mentioned function is one including an organic compound which has a surface comprising a hydrophobic radical having a surface self-orientation function. Another suitable material is an organic compound having a hydrophobic radical arranged on the surface of the organic compound.

The above mentioned surface self-orientation function is a function in which a hydrophobic radical on a surface of a compound is oriented toward an open air side (free surface side) when the compound is heated in the open air. Generally, hydrophobic radicals of organic compounds tend to orient toward a hydrophobic atmosphere. This is a phenomenon caused by a tendency of an interfacial energy of a solid-gas interface toward a decreased condition. This phenomenon occurs as a molecular length of the hydrophobic radical becomes longer. This is because the longer the molecular length is, the higher the mobility of the molecule is when heated.

Further, a molecule having at the end thereof a hydrophobic radical tends to perform a surface orientation toward the air (free surface side). Straight-chained molecules including $(—CH_2—)n$ has a tendency such that the chains become oriented with each other because a portion in each chain comprising $(—CH_2CH_2—)$ has a plane structure. A molecule including (—Ph—)n has a similar tendency since the portion (—Ph—), which is a P-phenylene radical, has a plane structure. Especially, a straight-chained molecular including an element having a high electronegativity has a high self-cohesion, and thus the chains tends to become oriented.

In conclusion, it is said that compounds having a high surface self-orientation function include a molecule having a self-cohesive molecule or a straight-chained molecule having a hydrophobic radical at the end thereof.

A surface self-oriented condition and a receding contact angle have a close relationship, and an adhesion of liquid to the corresponding surface is related to the receding contact angle of the surface. The adhesion of liquid onto a surface of a solid occurs mainly by a tacking of the liquid on the surface of the solid. This tacking is regarded as a kind of friction force between a liquid and a solid when the liquid moves on a surface of the solid. Accordingly, the following relationship is obtained.

$$\cos\theta r = \tau(\tau s - \tau se - \pi e + \tau f)/\tau ev$$

Where $\theta r$ is a receding contact angle;

$\tau$ is a surface tension of a solid in a vacuum condition;

$\tau se$ is an interfacial tension of a solid-liquid interface;

$\tau ev$ is a surface tension of a liquid in a condition where the liquid is in contact with its vapor;

$\pi e$ is an equilibrium surface tension;

$\tau f$ is a friction tension; and $\tau s$ is a surface tension of a solid having no absorption layer.

Judging from the above relationship, if a value of $\theta r$ decreases, a value of $\tau f$ increases. This means that if a receding contact angle decreases, a liquid tends to stay on a surface of a solid and thus the liquid adheres to the surface of the solid. An adhesion of a liquid depends on the receding contact angle $\theta r$, and the receding contact angle depends on characteristics of the material having the surface self-orientation function. Accordingly, for the recording material (A) used in the recording method according to the present invention, the material having a surface self-orientation function is selected so that a latent image is formed on the recording material (A).

A description will be given below of a contacting material (B). The contacting material (B) comprises a liquid or a vapor. The contacting material (B) may be a solid which changes phase to a liquid phase or a vapor phase at or below the temperature at which the decrease of the receding contact angle of the recording material (A) begins. At least the part of the vapor should be condensed into a liquid on the surface of the recording material (A) so that the surface is wet with the liquid (condensed vapor).

A liquid used as a contacting material (B) is, for example, a water, a water solution including an electrolyte, an alcohol such as an ethanol or an n-butanol, a polyhydric alcohol such as a grycerol or an ethylene glycol, polarized liquid such as a ketone including a methyl ethyl ketone, a straight-chained hydrocarbon such as an n-nonan or an n--octane, a cyclic hydrocarbon such as a cyclohexane, or a non-polarized liquid such as an aromatic hydrocarbon including a m-xylene or a benzene. Additionally, a mixture of the above liquids, various dispersed liquids, or liquid inks may also be used. Also, a polarized liquid may be advantageously used.

For the contacting material (B) in the vapor, any vapor of the above mentioned liquids may be used. Especially, an ethanol vapor and m-xylene vapor (including their mist) are suitable. The temperature of the organic compound's vapor is required to be below the temperature of a melting point or a softening point of the recording material (A).

For the contacting material (B) in the solid, a high grade fatty acid, a low molecular-weight polyethylene, macromolecular gel (a polyacrylamide gel, a polyvinyl alcohol gel), silica gel or a compound containing a crystalline water may be used.

As a means for supplying the contacting material (B), for example, a construction provided with a container filled with a liquid and provided with a heat source located adjacent to or inside the container is considered to be simplest. Instead of the container, a sponge-like material having absorbed the liquid may be used.

As a heating means for forming a latent image, a heater or a thermal head that performs a contact heating, may be used. By using this means, a heat is applied in a state where the heater is in contact with the material to be heated. Another way of applying heat is through use of electromagnetic waves such as produced by a laser beam generator or an infrared beam lamp, which is a non-contact heating method.

The surface of the recording material (A) is heated, after the transfer operation of an image has been completed, in an atmosphere where there is no liquid or vapor present. The atmosphere may be, for example, air or an inert-gas. The heating temperature may range from 50 degrees to 300 degrees Celsius and preferably it should be between 100 degrees to 180 degrees. The heating time may range from 1 msec to 10 sec, but it should preferably be 10 msec to 1 sec. By this heating operation, the recording material (A) can be repeatedly used.

As a heating means for erasing a latent image on the recording material (A), a heating source similar to the one used for forming the latent image may be used. A heat can be applied either on only a portion where the latent image is formed or on the entire surface of the recording material (A). Heating of the entire surface is preferable because the construction of the entire apparatus can be simplified by such a construction.

It should be noted that means for erasing a latent image are provided in a position distant from a heating means for forming a latent image, so that the recording material cools before it reaches the heating means for forming the latent image next. Although the temperature required to erase the latent image depends on the material, the temperature should be in the range from the temperature at which a decrease of the receding contact angle begins, to the temperature of a melting or softening point of the recording martial (A).

As a recording paper one of the following may be used: a plastic film, plain paper, synthetic paper, recording paper for an ink-jet printer, or typing paper.

In the recording method according to the present invention, a fine powder of the recording material (A) is dispersed into a recording agent including a coloring agent (hereinafter called ink). The powder grains should be considerably smaller than a size of a dot of latent image. For example, a powder size of less than 10 μm is required for a dot size of 200 dpi. An amount of the powder to be contained in the recording agent may be 1 to 60 weight percent, preferably 10 to 40 weight percent. The ink may be either pigment or dye based. In the case where a dye base ink is used, there is a possibility that the dye adhered on the recording material (A) dissolves in the liquid during forming of the latent image. Accordingly, the pigment based ink, which is nearly insoluble in a solvent, is more suitable than the dye based ink.

Figure 2:
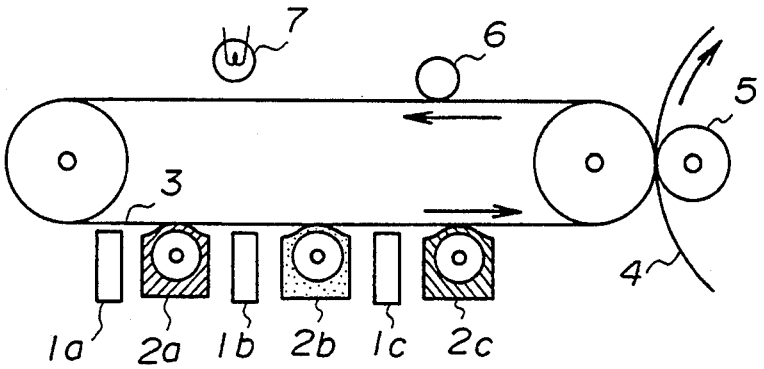
FIG. 2 is a schematic illustration of a first embodiment of a recording apparatus using a recording method according to the present invention.

A detailed description will now be given of the recording method according to the present invention. FIG. 2 is a schematic illustration of a first embodiment of a recording apparatus using the recording method according to the present invention. In FIG. 2 parts that are the same as parts shown in FIG. 1 are given the same reference numerals from figure to figure, and descriptions thereof will be omitted.

In the recording apparatus shown in FIG. 2, a first-color latent image is formed by a first latent-image forming device (heater) la and a color ink 2*a* having a first color. A second-color latent image is formed by a second latent-image forming device (heater) 1*b* and a color ink 2*b* having a second color. A third-color latent image is formed by a third latent-image forming device (heater) 1*c* and a color ink 2*c* having a third color. At least three units, each of which units combines use of a heater and a color ink, are required for forming a full-color picture.

Figure 3:
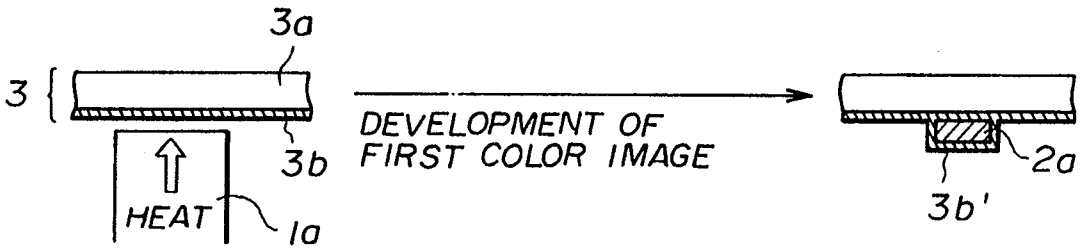
FIG. 3 is an illustration for explaining a first color latent image.

FIG. 3 is an illustration for explaining a forming operation of a first-color latent image. As shown in (a) of FIG. 3, the recording material 3 comprises a recording material base 3*a* and a recording material layer 3*b* provided on the recording material base 3*a*. The recording material layer 3*b* is formed of the recording material (A) as mentioned above. That is, a receding contact angle of the recording material layer 3*b* decreases when it is in contact with a liquid in a condition where the recording material layer 3*b* is heated.

Referring back to the description of the apparatus shown in FIG. 2, the first-color latent image is formed on the recording material layer 3*b* by partially heating the recording material layer 3*b* by means of the first latent-image forming device 1*a*. The heated portion is made to come into contact with the first color ink 2*a* so as to form a visible image corresponding to the first latent image. If the latent image is formed as a finely dotted image (for example, 200 dpi with a dot size of from 100 $\mu$m$\times$100 $\mu$m to 200 $\mu$m$\times$200 $\mu$m), the first color ink 2*a* dries rapidly. If necessary, a heater may be provided immediately after the adhesion process of the first color ink so as to increase the speed of the drying time.

Figure 4:
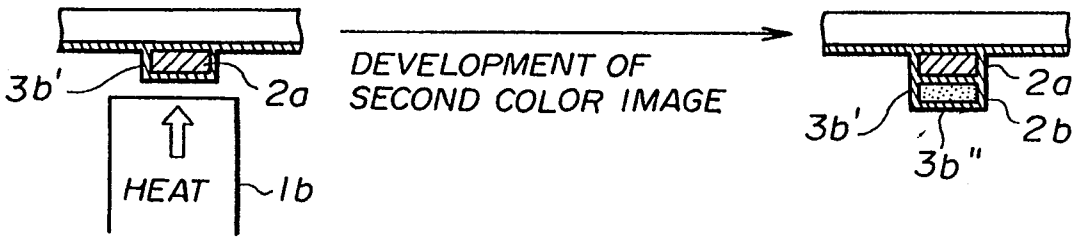
FIG. 4 is an illustration for explaining a second color latent image.

The first color ink 2*a* contains, as mentioned above, a fine powder of the recording material layer 3*b*. When the first color ink 2*a* dries, the dried ink is covered with a recording material layer 3*b*'. The second latent image is then formed, by the second color latent-image forming means 1*b*, on the recording material layer 3*b*', as shown in (a) of FIG. 4. Similarly to the forming process of the first color image, the second color ink is made to come into contact with the latent image formed on the recording material layer 3*b* and is then dried. The second color ink 2*b* also contains a powder of a recording material layer 3*b* used to form a recording material layer 3*b*'' on the second color ink as shown in (b) of FIG. 4. The third color image is formed in the same manner as is the second color image. The third color ink 2*c* does not contain the fine powder of the recording material 3*b* because no latent image is to be formed on the third color ink 2*c*.

After all the color images are formed, the image on the recording material 3 is transferred onto the recording paper 4 while heating and pressing the recording paper with the transfer roller 5. Although the recording material layers 3*b*' and 3*b*'' are formed on the respective color inks, the inks are easily transferred onto the recording paper 4 due to the heat and pressing force exerted by the heat roller 5. Since the transfer of all color images is performed in one operation, the displacement between each color image is minimized, and thus a recording of a high quality color picture is performed.

After the transferring operation, the remaining recording material layers 3*b*' and 3*b*'' are scraped by means of the cleaner 6. Then, a heat is applied by the erasing heater 7 so as to erase the latent image so that the next recording operation can be performed.

Figure 5:
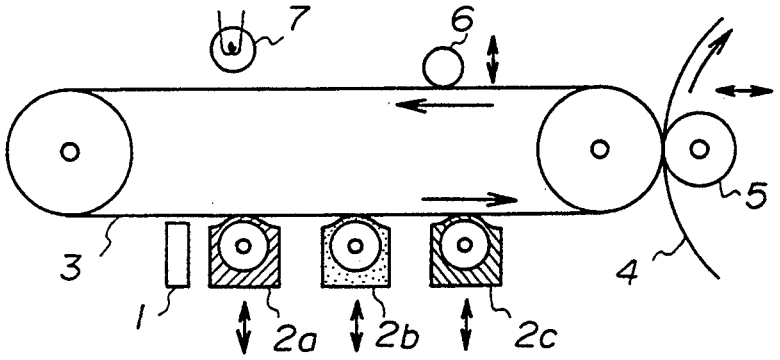
FIG. 5 is a schematic illustration of a second embodiment of a recording apparatus according to the present invention.

FIG. 5 is a schematic illustration of a second embodiment of a recording apparatus according to the present invention. In FIG. 5, parts that are the same as parts shown in FIG. 1 are given the same reference numerals from figure to figure, and descriptions thereof will be omitted. The second embodiment has only one latent image forming apparatus 1 that is commonly used for forming all latent images. The forming of one latent image is performed by one rotation of the recording material 3, and after the forming of three colors are completed, the transfer operation and the cleaning are performed similarly to the operations performed in the second embodiment. Accordingly, the cleaner 6 is movable up and down or left and right with respect to the surface of the recording material 3, after the forming of three color images are completed, so that the cleaning of the latent image is performed. When using this recording apparatus, similarly to the first embodiment, the color inks 2*a* and 2*b* should contain a fine powder of the recording material 3. According to this embodiment, although the recording time for one picture is longer than that of the first embodiment, only one latent image forming device is provided, thus enabling the apparatus to become compact and minimizing manufacturing costs.

Figure 6:
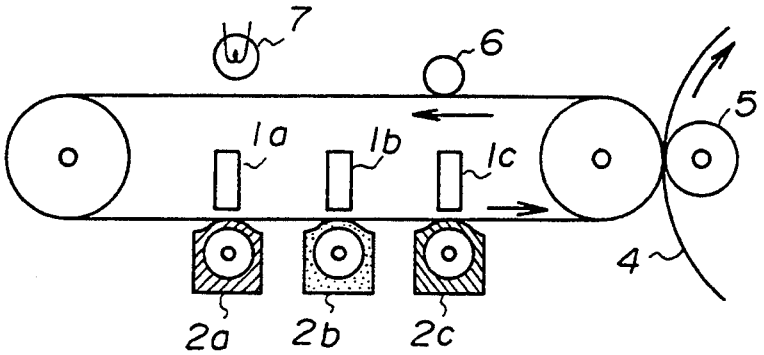
FIG. 6 is a schematic illustration of a third embodiment of a recording apparatus according to the present invention.

FIG. 6 is a schematic illustration of a third embodiment of a recording apparatus according to the present invention. In FIG. 6, parts that are the same as parts shown in FIG. 1 are given the same reference numerals from figure to figure, and descriptions thereof will be omitted. In the third embodiment, by providing each of the latent-image forming devices 1*a*, 1*b*, 1*c* at a portions opposite, with respect to the recording material 3, the respective ink containers 2*a*, 2*b*, and 2*c*, the latent image formation and the development of each color image are simultaneously performed. Thus, a reduction of the recording time is obtained.

It should be noted that in the above three embodiments, displacement between each color dot can be controlled by providing a position detecting sensor for detecting the first color dot. Such a sensor can be realized by means of a light source such as a laser beam and a light receiving element such as a photodiode.

A description will be given below of specific examples of the present invention.

EXAMPLE 1

Recording Material:

An acrylate material containing fluorine, TG-702 (manufactured by Daikin Industry Co., Ltd.), three times diluted with Freon TF (manufactured by Mitsui Fluorochemical Co., Ltd.) was coated on a polyimide film. The resulting material was dried at 130° C., for 30 minutes.

Contact Material: Water

Ink:

A fine powder emulsion of the recording material, NOXGUARD EX-125 (manufactured by NOK Krewber) was mixed with a water based pigment ink (yellow, magenta, cyan). The ink contained pigment of 4 wt %. Weight ratio of the ink to EX-125 was 3:2.

Apparatus Construction:

The apparatus shown in FIG. 2 was used.

Results of the Recording:

A high quality picture was obtained without displacement between colors.

EXAMPLE 2

Recording Material:

An Acrylate material emulsion containing fluorine, NOXGUARD EX-125 (manufactured by NOK Krewber), was coated on a polyimide film. The resulting material was dried at 130° C., for 30 minutes.

Contact Material: Water

Ink:

A fine powder emulsion of the recording material, NOXGUARD EX-125 (manufactured by NOK Krewber) was mixed with a water based dye ink (yellow, magenta, cyan). The ink contained dye of 7 wt %. Weight ratio of the ink to EX-125 was 3:2.

Apparatus Construction:

The apparatus shown in FIG. 5 was used.

Results of the Recording:

A high quality picture was obtained without displacement between colors.

EXAMPLE 3

Recording Material:

An Acrylate material containing fluorine, TG-702 (manufactured by Daikin Industry Co., Ltd.), three times diluted with Freon TF (manufactured by MItsui Fluorochemical Co., Ltd.), was coated on a polyimide film. The resulting material was dried at 130° C., for 30 minutes.

Contact Material: Water

Ink:

A fine powder emulsion of the recording material, NOXGUARD ET-124 (manufactured by NOK Krewber) was mixed with a water based pigment ink (yellow, magenta, cyan). The ink contained pigment of 4 wt %. Weight ratio of the ink to ET-124 was 3:2.

Apparatus Construction:

The apparatus shown in FIG. 6 was used.

Results of the Recording:

A high quality picture was obtained without displacement between colors.

The present invention is not limited to the specifically disclosed embodiments, and variations and modifications may be made without departing from the scope of the present invention.

What is claimed is:

1. A recording method in which a liquid adhesion region and a liquid non-adhesion region of a surface of a material are utilized in a recording process, which recording method comprises the steps of:

(a) forming a latent image by partially applying heat to a single recording material, said recording material including a surface having a receding contact angle which receding contact angle decreases when a temperature of said surface becomes more than a predetermined temperature in the presence of a contacting liquid;

(b) contacting said recording material with a contacting liquid in a condition where a temperature of said surface is at or exceeds said predetermined temperature;

(c) forming a visible first color image corresponding to said latent image by causing said surface to contact a recording agent containing a first coloring agent and a fine powder of said recording material;

(d) repeating steps (a)–(c) to form visible second and subsequent color images by causing said surface to come in contact with a recording agent containing a second or subsequent coloring agent and a fine powder of said recording material, each of said color images except for the color image formed first being formed on a layer formed of said fine powder contained in a previously applied recording agent; and (e) transferring said visible color images from said recording material onto a recording paper.

2. The recording method as claimed in claim 1, wherein said recording agent comprises a liquid, and said fine powder is dispersed in said recording agent.

3. A recording apparatus in which a liquid adhesion region and a liquid non-adhesion region of a surface of a material are utilized in a recording process, which recording apparatus comprises:

(a) latent-image forming means for forming a latent image by partially applying a heat to a recording material, said recording material including a surface having a receding contact angle which receding contact angle decreases when a temperature of said surface becomes more than a predetermined temperature in the presence of a contacting liquid;

(b) contacting means for contacting a surface of said recording material with a contacting liquid in a condition where a temperature of said surface is at or exceeds said predetermined temperature;

(c) first visible-image forming means for forming a visible first color image corresponding to said latent image by causing said surface to contact a recording agent containing a first coloring agent and a fine powder of said recording material;

(d) second and subsequent visible-image forming means for forming a visible second or subsequent color image corresponding to said latent image by causing said surface to come in contact with a recording agent containing a second or subsequent coloring agent and a fine powder of said recording material, each of said color images except for the color image formed first being formed on a layer formed of said fine powder contained in a previously applied recording agent; and (e) transferring means for transferring said visible color images from said recording material onto a recording paper.

4. The recording apparatus as claimed in claim 3, further comprising a recording material rotating means for rotating said recording material, and wherein a plurality of pairs of said latent-image forming means and said visible-image forming means are arranged along a rotating direction of said recording material.

5. The recording apparatus as claimed in claim 3, further comprising a recording material rotating means for rotating said recording material, and wherein a single latent-image forming means and a plurality of said visible-image forming means are arranged along a rotating direction of said recording material.

6. The recording apparatus as claimed in claim 5, further comprising a cleaning means for cleaning said latent image after said visible images are transferred on to a recording paper, and wherein said cleaning means is movable between a first position where said cleaning means is in contact with said recording material so as to remove a remaining said layer of said recording material and a second position where said cleaning means is a predetermined distance away from said first position so that said cleaning means cleans said surface of said recording material after a plurality of color images are formed, each of said color images being formed during one rotation of said recording material.

7. The recording apparatus as claimed in claim 3, further comprising a recording material rotating means for rotating said recording material, and wherein a plurality of pairs of said latent-image forming means and said visible-image forming means are arranged along a rotating direction of said recording material, said latent-image forming means and said visible-image forming means being arranged on opposite side of said recording material with each other.

8. The recording apparatus as claimed in claim 3, further comprising a cleaning means for cleaning said latent image after said visible images are transferred on to a recording paper, and a heating means for heating said surface of said recording material so as to erase said latent image formed on said surface.

9. The recording apparatus as claimed in claim 8, wherein said heating means applies a heat over an entire surface of said recording material.

* * * * *